US005350134A

United States Patent [19]

Crawford

[11] Patent Number: 5,350,134

[45] Date of Patent: Sep. 27, 1994

[54] TARGET IDENTIFICATION SYSTEMS

[75] Inventor: Ian D. Crawford, Edinburgh, Scotland

[73] Assignee: GEC Ferranti Defence Systems Limited, Stanmore, England

[21] Appl. No.: 374,791

[22] Filed: Jul. 3, 1973

[51] Int. Cl.[5] ..... F41G 7/26

[52] U.S. Cl. ..... 244/3.16; 244/3.11

[58] Field of Search ..... 244/3.16, 3.17, 3.11, 244/3.13

[56] References Cited

U.S. PATENT DOCUMENTS 3,698,811 10/1972 Weil ..... 244/3.17
3,743,217 7/1973 Turck ..... 244/3.16
3,778,007 12/1973 Kearney, II et al. ..... 244/3.16
3,782,667 1/1974 Miller, Jr. et al. ..... 244/3.16

*Primary Examiner*—Ian J. Lobo
*Attorney, Agent, or Firm*—Kerkam, Stowell, Kondracki & Clarke

[57] ABSTRACT

A target identification system includes a target marker for selecting, and directing radiation at, a target, a weapon delivery system, and means for establishing a two-way communication channel between the two by reflection from a selected target. The communication is by infra-red laser and coded information is sent between the target marker and the weapon delivery system to identify the selected target.

26 Claims, 3 Drawing Sheets

TARGET IDENTIFICATION SYSTEMS

This invention relates to target identification systems and in particular to systems for identifying to a weapon delivery system a target selected by a target marker.

Frequently in modern warfare a target selected by an observer is required to be attacked by an independent weapon delivery system, this being of special importance when the observer is not in a position to deliver the most suitable type of weapon. One typical example of such a requirement is the calling of air strikes by ground troops. In an instance such as this a saturation attack may be delivered, but instances will arise where it is possible to select a single target which may be attacked by a single weapon. For example, an aircraft may be called upon to destroy a single tank which may not be visible to the pilot due to camouflage or other factors. Simple use of a radio link to describe the location of the target to the pilot of a fast-moving, possibly supersonic, aircraft is far from satisfactory.

With any such target identification system it is to be expected that a selected target will attempt to employ countermeasures, both electronic and physical. An effective system has therefore to be able to combat any such countermeasures to ensure correct identification of the target.

It is an object of the invention to provide a target identification system for uniquely and accurately identifying to a weapon delivery system a target selected by a target marker.

According to the present invention there is provided a target identification system which includes a target marker capable of selecting a target, a weapon delivery system to which the target is to be identified, means for establishing between the target marker and the weapon delivery system a two-way communication channel over which pulsed radiation may be transmitted from one to the other by reflection from the selected target, and means for so encoding the radiation transmitted over the communication channel as to identify uniquely the selected target to the weapon delivery system.

The expression "weapon delivery system" as used in this specification is intender to cover all means of delivering a weapon to its target. It includes, for example, aircraft delivering guided or ballistic missiles, guns, and guided missiles themselves. The expression "target marker" is used to indicate apparatus for selecting, and directing radiation at, a target. Such apparatus may be vehicle-mounted.

An embodiment of the invention will now be described, by way of example, with reference to the accompanying drawings, in which.

Figure 1:
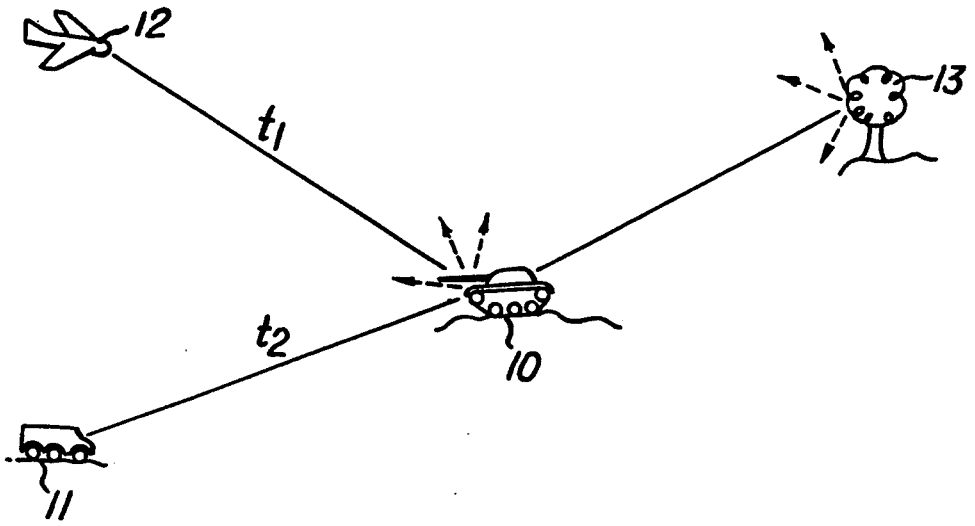
FIG. 1 is a diagram illustrating an application of the invention.

Referring now to FIG. 1, this shows a target 10, target marker 11 and weapon delivery system (e.g. an aircraft) 12. The target marker 11 carries an infra-red laser which is arranged to emit pulses of radiation at the selected target 10. The radiation is scattered from the target, and some of it returns to the target marker at time $2t_2$ to indicate the range of the target. Similarly, some of the radiation is detected by the aircraft 12. When the aircraft detects the radiation from the target it transmits an interrogating pulse towards the target. Since radiation from the target marker 11 reached the aircraft by reflection from the target it may be assumed that radiation from the aircraft will reach the target marker by the same path. If the aircraft emits a pulse at a time $t_o$, then it will reach the target marker at a time $(t_o+t_1+t_2)$ where $t_1$ and $t_2$ are the time taken for radiation to cover the two legs of the path shown in FIG. 1. The equipment in the target marker is arranged to respond to the interrogating pulse by transmitting a further pulse after a delay time $(t_c-2t_2)$, where $t_c$ is a predetermined delay interval and $t_2$ is already known from the target range. Hence the aircraft will receive a response to its interrogating pulse after a time interval of $$(t_o+t_1+t_2)+(t_c-2t_2)+t_1+t_2,$$

or $$(t_o+2t_1+t_c).$$

The aircraft will also receive a pulse reflected directly from the target after a time $(t_o+2t_1)$, which indicates the range of the target from the aircraft. The equipment carried by the aircraft is thus able to extract the time $t_c$ and confirm that this equals the predetermined delay interval. This then confirms that the target marker and aircraft are looking at the same target.

If the target 10 attempts to confuse the aircraft equipment by itself illuminating a false target 13, then any radiation emitted from the aircraft will not result in the necessary coded response including the time interval $t_c$, and it will thus be apparent that the target selector and the aircraft are not looking at the same target.

Figure 2:
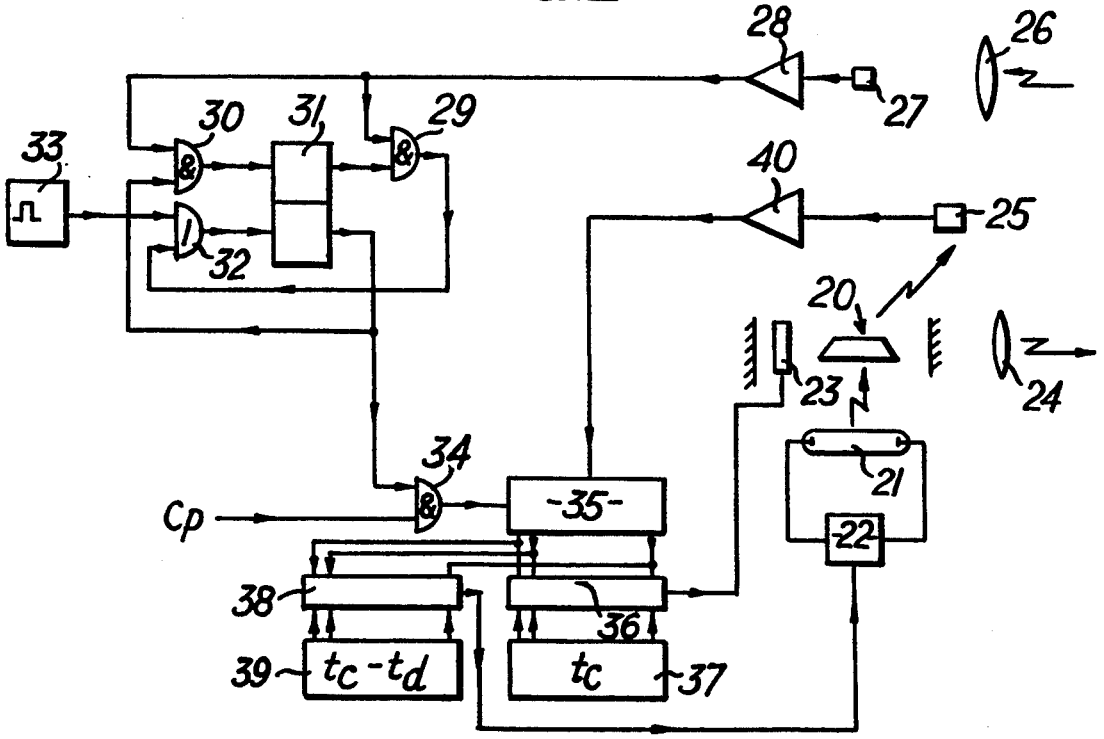
FIG. 2 is a part-schematic diagram of apparatus carried by the target marker.

The above description sets out the principle of operation of the invention. FIG. 2 shows the equipment carried by the target marker 11. The equipment may be divided into two sections, one comprising the radiation-transmitting or receiving section, and the other comprising the controlling electronics. The radiation source shown in FIG. 2 is a laser 20, preferably having a solid active medium and emitting infra-red radiation. The laser active medium is excited by a flash-tube 21 controlled by a triggered power supply 22. Included in the optical cavity of the laser is an electro-optic device 23, which, when pulsed electrically allows the optical cavity to resonate and emit infra-red radiation through a telescope optical system shown schematically at 24. A photo-sensitive device 25 is located so as to receive some of the radiated energy to provide an accurate indication of the time of emission of the laser pulse. A receiving optical telescope, illustrated schematically at 26, has its optical axis fixed parallel to that of the transmitting telescope 24, and directs any received radiation on to a photo-sensitive device 27.

The output of device 27 is fed through an amplifier 28 to an input of each of two AND gates 29 and 30. Gate 29 has as its other input the "reset" output of a bistable circuit 31, and the output of gate 29 is connected to one input of an OR gate 32. The other input of gate 32 is provided by a pulse generator 33 which generates a continuous train of pulses. The output of OR gate 32 forms the "set" input to the bistable circuit, and the corresponding "set" output is connected to the other input of AND gate 30. The output of gate 30 is connected to the "reset" input of the bistable circuit 31. The "set" output of the bistable circuit is also connected to one input of a two-input AND gate 34, and to the other input is connected a source of clock pulses CP. The output of this gate 34 is connected to the input of a counter 35. The outputs from the counter are connected to a comparator 36 which also receives the inputs from a register 37. The output from the comparator 36 triggers the electro-optic device 23 in the laser cavity. The outputs from the counter 35 are also connected to a second comparator 38 which also receives inputs from a second register 39. The output from comparator 38 triggers the power supply 22 of the laser flash-tube 21. The output from the photo-sensitive device 25 is fed through an amplifier 40 to the "reset" input of the counter 35.

The operation of the equipment shown in FIG. 2 is as follows:

The pulse generator 33 is arranged to operate at a predetermined rate, say ten pulses per second, which is known at least approximately to the equipment in the aircraft. A pulse from the pulse generator 33 passes through OR gate 32 and sets the bistable circuit 31. The set output from the bistable circuit primes the AND gate 34 so that each subsequent clock pulse is fed into the counter 35, the clock pulse frequency being very much higher than that of the pulse generator 33. When the count stored in the counter reaches the value representing a time $(t_c-t_d)$ set into register 39, the comparator 38 causes the flash-tube 21 to be fired. The inputs to the counter continue, and at a later time $t_c$, represented by the value stored in register 37, the comparator 36 triggers the electro-optic device 23 so that a laser pulse is transmitted towards the target. The time $t_c$ is a predetermined delay time, whilst the time $t_d$ is the time taken by the laser to build up maximum energy storage in the laser active medium after the flash-tube has been fired. The time $t_c$ represents the coding feature of the particular target marker.

When a laser pulse is emitted the photo-sensitive device 25 detects this and causes the counter 35 to be reset to zero. Further clock pulses are still applied to the counter which is now concerned with the measurement of target range. On receipt of a signal reflected from the target and received by photo-electric device 27, the output of amplifier 28 is applied to AND gates 29 and 30. Gate 30 already has applied to it the "set" output of the bistable circuit, and so the application of the signal from amplifier 28 causes the bistable circuit to change to its "reset" state. The gate 34 is therefore closed and the counter 35 stopped. The count stored in counter 35 represents the time between emission of the laser pulse and receipt of the reflected signal, that is $2t_2$, and hence indicates the range to the target.

The "reset" output applied to gate 29 has no effect since the other input has now ceased. The counter remains fixed until the pulse generator 33 produces its next pulse to "set" the bistable circuit via gate 32 and restart the procedure. Hence the equipment in the target marker will continue to transmit laser pulses under the control of the pulse generator, and will monitor the range to the target.

The weapon delivery system, such as an aircraft, is ready to detect any radiation scattered from a target in its field of view having the predetermined repetition rate. When such radiation in received the aircraft emits an interrogating pulse which is reflected by the target toward the target marker. This pulse is arranged to reach the target marker shortly before the next pulse is due from the pulse generator 33. This is possible because the transmission time $(t_1+t_2)$ will be measured in microseconds whereas the interval between pulses from the pulse generator is of the order of a hundred milliseconds.

The interrogating pulse is thus received at the target marker whilst the counter 35 is static and holding the count $2t_2$. The output from the detector 27 finds gate 30 blocked because bistable circuit 31 is in its "reset" state, but passes through gate 29 to "set" the bistable circuit via gate 32 and open gate 34 to further clock pulses. The counter thus advances from the count $2t_2$ to the count $t_c$ after an interval $(t_c-2t_2)$ after which the laser 20 is fired as described above. The target marker has thus replied to an interrogating pulse from the aircraft by itself transmitting a pulse after the time delay $(t_c-2t_c)$ microseconds.

Subsequently the target marker equipment is controlled by successive interrogating pulses from the aircraft.

Figure 3:
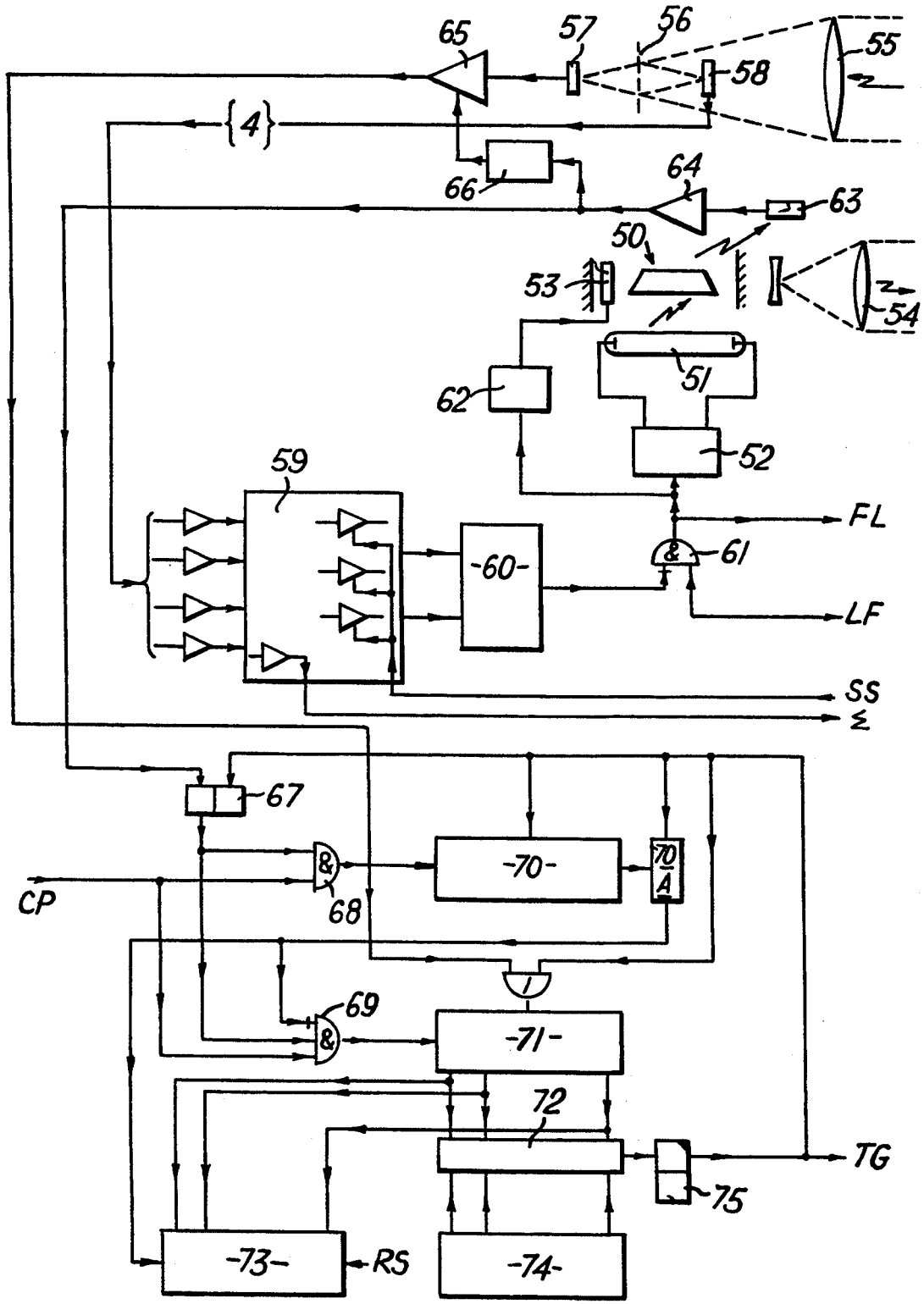
FIGS. 3 and 4 are part-schematic diagrams of apparatus carried by the weapon delivery system.
Figure 4:
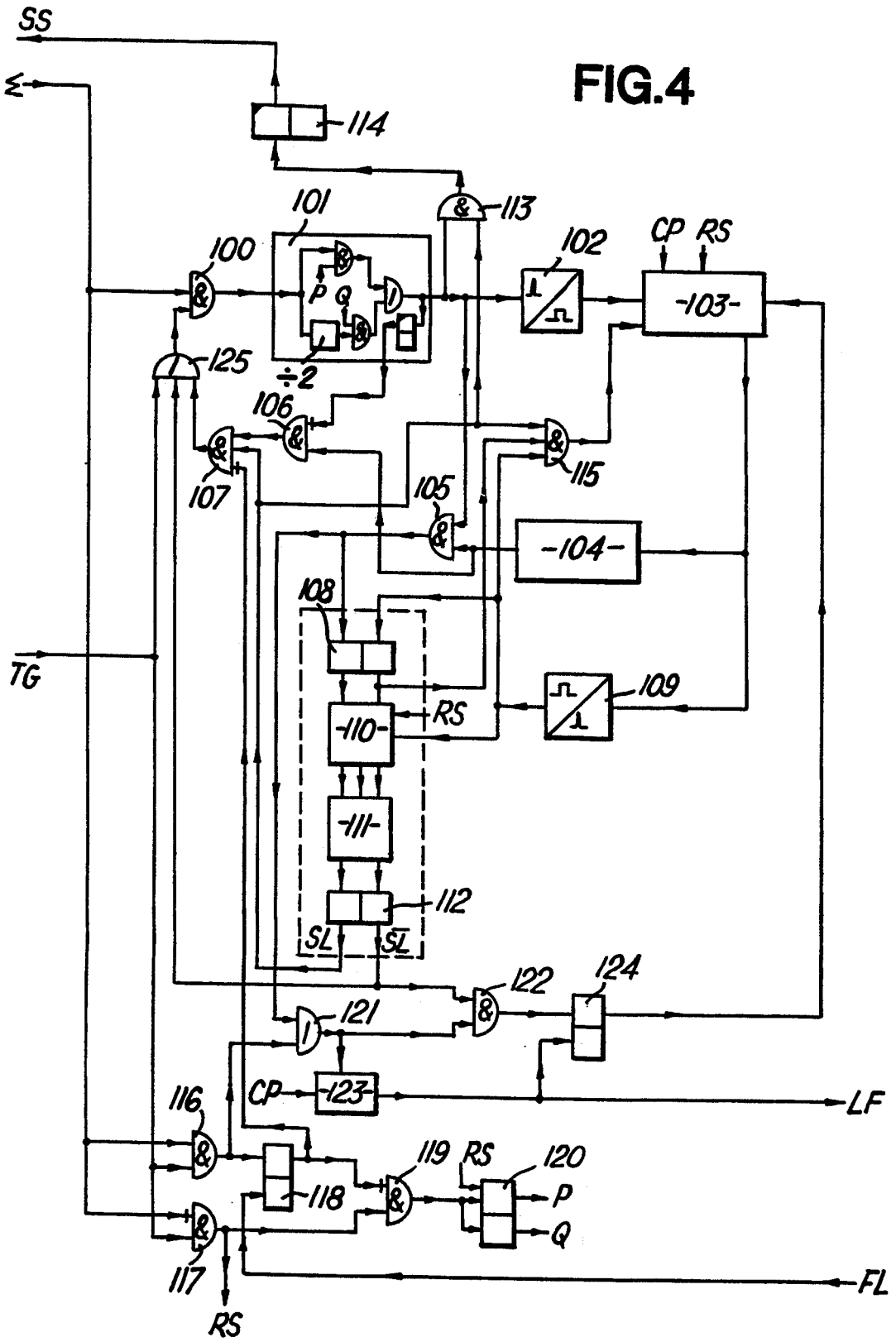

FIGS. 3 and 4 show the equipment carried by the weapon delivery system (e.g. the aircraft). This equipment is more complex than that carried by the target marker, and may be divided into three sections. These are the radiation transmitting and receiving section, the steering and stabilising arrangements for the optical system, and the controlling electronics.

As in the case of the target marker equipment, the radiation source shown is an infra-red laser 50 excited by a flash-tube 51 which is controlled by a triggered power supply 52. Included in the optical cavity of the laser is an electro-optic device 53 which when pulsed electronically allows the optical cavity to resonate and emit infra-red radiation through an optical system shown at 54. A receiving optical telescope, preferably of the reflecting type, has an optical system represented by a lens 55 which directs the received radiation onto a beam-splitting element 56. Some of the received radiation passes through the beam-splitter on to a photo-sensitive device 57 whilst some is reflected back onto a photo-sensitive device 58. The device 58 is made in four sectors so that the relative magnitudes of the outputs from the sectors indicates the direction of the incident radiation, relative to the optical axis of receiving telescope 55.

The outputs of the photo-sensitive device 58 are used to control a servo system which steers the optical systems of the two telescopes in elevation and azimuth so as effectively to point the two telescopes in the direction of the radiation source, that is the target. The servo system comprises a signal processor 59 which controls an associated servo unit 60. The signal processor takes the signals from the four sectors of detector 58, say signals A, B, C, and D, and delivers three outputs. One of these ($\epsilon$) represents the sum (A+B+C+D) of the four signals, whilst the other two represent the elevation signal (A+B)−(C+D) and the azimuth signal (A+D)−(B+C) for the servo unit 60. The servo unit, as well as moving the two telescopes mechanically also produces an error signal output which is applied to an inhibit gate 61 which controls the firing of the laser, and delivers a "fire laser" FL signal to FIG. 4. As with the target marker, the flash-tube 51 of the laser is fired through its power unit 52 before the device 53 in the laser optical cavity is activated via the delay device 62. A photo-electric device 63 is provided to detect the instant of firing of the laser. This detector is connected to an amplifier 64, the output of which is used to strobe an amplifier 65 having applied to it the output of the photo-electric device 57. The strobing is performed by a range gate generator 66.

The output of the amplifier 64 is connected to the "set" input of the bistable device 67. The "set" output of the bistable device is connected to one input of each of two AND gates 68 and 69. Each of these two last-mentioned gates has a clock pulse input CP, and gate 69 also has an inhibit input from a counter as described below. The output gate 68 forms the stepping input of a master counter 70. The final stage of this counter, shown as a separate stage 70A, has its output connected to the inhibit input of gate 69. The output of gate 69 forms the input of a second counter 71, the range counter. The reset input of the range counter 71 is connected to the output of amplifier 65. The outputs of the various stages of the range counter are connected to a comparator 72 and to a display register 73. A coding register 74 also has its outputs connected to the comparator 72. The output of the comparator is connected to the "set" input of a monostable device 75, the output of which is a "transponding gate" signal TG. The transponding gate signal may conveniently be used to reset bistable device 67 and counters 70 and 71 in preparation for the next ranging shot.

The master counter has one more stage than is necessary to register the maximum possible value of the time interval $2t_1$ (see FIG. 1) between the emission by the aircraft of an interrogating pulse and the returning primary echo from the target. Such maximum time interval will be denoted as $2t_{1m}$.

The controlling electronics carried by the aircraft also includes means for authenticating the received signals, and this is shown in FIG. 4.

The sum signal output $\epsilon$ from the servo signal processor 59 is applied through an AND gate 100 to a signal selector 101. As shown this comprises an arrangement of gates in two parallel paths. One path has a gate primed by a signal P, whilst the other path comprises a divide-by-two circuit and a gate primed by a signal Q. The outputs from the two paths pass to a monostable circuit and through a pulse-shaper 102 to a decoding register 103. The decoding register is basically a shift register through which the input pulses are shifted by the clock pulses CP, emerging from the register at some later time. The output from the decoding register is applied to a coincidence gate generator 104. This is basically a monostable circuit arranged to produce a 300 microsecond gating pulse when triggered by an output from the decoding register. The output of the coincidence gate generator forms on e input of a two-input AND gate 105, the other input being the output from signal selector 101. The output of the coincidence gate generator 104 also forms one input of an inhibit gate 106, the inhibit input being provided by the output from the monostable device in the signal selector 101. The output of gate 106 forms one input of AND gate 107.

The output of AND gate 105 is connected to the "set" input of a bistable device 108. The output of the decoding register 103 is also connected via a pulse shaper 109 to the "reset" input of this bistable device. The set and reset outputs of the bistable device are connected to a three-stage shift register 110. The shift clock input is applied from the pulse shaper 109. The various stages of the shift register 110 are applied to a system of gates 111, forming a "signal lock condition" generator such that when all three stages of the shift register are in a predetermined state a bistable 112 is "set" to produce a "signal lock" output SL.

Bistable circuits 108 and 112, shift register 110 and gating circuit 111 together form a three-coincidence detector shown within a broken line.

The signal lock output SL forms another input of gate 107 and one input of an AND gate 113, the other input of the latter being the output of the signal selector 101. The output of gate 113 is used to set a monostable device 114 which provides a signal SS which strobes the outputs of the servo signal processor 59 (FIG. 3). The signal lock output SL also forms one input of AND gate 115, together with signals from the pulse shaper 109 and the reset output of bistable device 108. The output of gate 115 is connected to the decoding register 103.

The sum output $\epsilon$ from the signal processor 59 (FIG. 3) is applied to two gates 116 and 117, to the latter as an inhibit input. To the other input of each of these gates is applied the TG output of monostable device 75. The output of gate 116 is applied to the "set" input of bistable device 118, the set output of which is applied to the inhibit input of AND gate 107 and to an inhibit input of gate 119. Bistable device 118 has its "reset" input connected to the FL output of gate 61 (FIG. 3). The other input of gate 119 is the output of gate 117, which also provides a system reset signal RS connected to various units shown on FIGS. 3 and 4. The output of gate 119 is connected to the shift input of a JK flip-flop 120. The outputs of this are the control signals P and Q for the gates in the signal selector 101.

The output of gate 116 is also connected to the input of OR gate 121, the other input being connected to the output of gate 105. The output of gate 121, together with the "reset" output of bistable device 112, form the inputs of AND gate 122 and the reset input for auxiliary counter 123, clocked by clock pulses CP. The output of gate 122 forms the "set" input of a bistable device 124, the reset input of which is the output of the auxiliary counter 123. The "set" output of the bistable device 124 is connected to the decoding register 103. The output of the auxiliary counter 123 forms the "Laser Fire" (LF) input of gate 61 (FIG. 3). The output of AND gate 107, together with the $\overline{SL}$ output from bistable device 112 and the TG output from monostable device 75 form the inputs of OR gate 125, the output of which forms the second input of AND gate 100.

As already indicated, the function of the equipment shown in FIGS. 3 and 4 is to detect radiation reflected from a designated target, interrogate the target marker and at the same time measure the target range, and finally detect a response from the target marker and check its authenticity.

Whilst the aircraft is awaiting receipt of a train of laser pulses from the target the equipment of FIGS. 3 and 4 is set to its initial conditions. Bistable device 67 is reset and the master counter 70 and range counter 71 are set to zero. The required coding delay is set into the coding register 74, and the display register 73 is cleared. The decoding register 103 in cleared and the shift register 110 in the coincidence detector is reset. The JK flip-flop 120 is set to the desired state, say to give the output P for the signal selector 101.

The receiving telescope carried by the aircraft is arranged such that the sectored detector 58 has a wide-angle of view, whilst detector 57 has only a narrow angle. Hence, supposing that a target is detected whilst the telescope is out of alignment, only detector 58 will receive the incoming pulse train. Even in the rare case of perfect telescope alignment, amplifier 65 is blocked by the absence of a strobe pulse from range gate generator 66.

Incoming pulses detected by detector 58 are applied as the output $\epsilon$ via the signal processor 59 through gate 100 to the signal selector 101. Gate 100 is opened by the presence of the $\overline{SL}$ output from bistable 112 and a signal is passed through stage 101 via the path containing the gate primed by the signal P from flip-flop 120. The output from the signal selector 101 passes through the pulse shaper 102 to the decoding register 103. This is arranged to detect pulses occurring at the present pulse rate, and such pulses passing through the decoding register 103 are applied to the coincidence gate generator 104. This generates a 300 microsecond gating pulse for each received pulse, these gating pulses being applied to AND gate 105. The other input to AND gate 105 is the signal selector output. Hence if the pulses emerging from the coincidence gate generator are produced by a genuine received pulse from the target marker, they will coincide with later received pulses passing through the signal selector. The resultant output from gate 105 is applied to bistable device 108 and hence to the shift register 110.

The output from gate 105 also passes through OR gate 121 to trigger the auxiliary counter 123 and, together with $\overline{SL}$ signal from bistable device 112 applied to gate 112 "set" bistable device 124. The output of this bistable device blanks off the decoding register 103 for a time determined by the auxiliary counter 123, which then resets bistable device 124. The blanking signal applied to the decoding register prevents pulses emerging from the decoding register other than at the expected time determined by the present pulse rate.

The above process is repeated until three coincidences between coincidence gate pulses from generator 104 and pulses from signal selector 101 have been detected. It is then assumed that the received pulse train is genuine, and the gating circuit 111 causes bistable device 112 to be "set" to give the signal lock signal SL.

The removal of the $\overline{SL}$ signal from gate 125 closes gate 100 but the new SL signal applied to gate 107 allows the output of the coincidence gate to be applied via gate 106 and 107 to open gate 100 only during a coincidence gate pulse. All extraneous received pulses are excluded from the decoding register 103 by the operation of the monostable device in the signal selector 101. The removal of the $\overline{SL}$ signal also prevents the generation of further blanking pulses by bistable device 124, since gate 122 is now closed.

The SL signal is also applied to gate 113, together with the selected outputs from the signal selector 101. This allows monostable device 114 to be set for a short time to provide the SS signal to sample the signals from the detector 58 and apply control signals to the servo 60. Each incoming pulse is now sampled and the servo driven until the telescope is pointing directly at the apparent source of pulses, in this case the target from which the marker's pulses are being reflected.

When the servo error is reduced to zero, gate 61 responds to the next LF output of the auxiliary counter 123 and initiates firing of the aircraft's own laser. The laser power unit 52 and flash-tube 51 are triggered by the output from gate 61, followed after a short delay determined by delay unit 62 by the activation of the electro-optical device 53. This allows the emission of a laser pulse of maximum intensity through the telescope 54.

The emission of the transmitted laser pulse is detected by the detector 63. This operates the range gate generator 66 to enable amplifier 65 to pass an expected echo return, and also sets the bistable device 67. The "set" output of this device primes gates 68 and 69, and hence allows clock pulses CP to be applied to the master counter 70 and range counter 71.

The primary echo from the target is detected by detector 57, passed by amplifier 65, and resets the range counter 71. If there are several primary echos, such as from cloud, the range counter is reset by each one. This is necessary since, in such conditions it is the least-received primary echo that is from the target. Hence, after the receipt of the least primary echo the range will lag on the master counter by a count representing the time interval $2t_1$ (FIG. 1). The output of range counter 71 is also applied to the display register 73.

When the master counter 70 has counted up to its maximum, which is after a period of 80 microseconds, the output of the extra stage 70A changes, whilst the counter counts for a further 80 microseconds. The appearance of the output from stage 70A inhibits gate 69 and prevents the application of further clock pulses to the range counter 71. At the same time the display register 73 is caused to accept the count stored in the range counter to be used as an indication of target range (in complementary form). When the master counter has counted up to $(t_o+160)$ microseconds, it returns to zero, thus removing the inhibit input from gate 69 and allowing range counter 71 to restart. The range counter thus restarts from a value representing a time $(80-2t_1)$ microseconds up to the value set into the coding register 74. This value represents $(t_c-80)$ microseconds since the range counter is held static to allow for transfer of its contents to the display register 73.

When the count in the range counter 71 equals that set into the coding register 74, the comparator 72 delivers an output which "sets" the monostable device 75 to deliver a transponding gate pulse TG of 100 nanoseconds duration. The TG signal opens gate 100 via OR gate 125 at a time when a response would be expected. If a response is received during the TG pulse then gate 116 operates to inhibit any change of state of JK flip-flop 120 and to start counter 123 via gate 121. This initiates the firing of the aircraft laser for a second time, and the above procedure is repeated. Gate 116 also inhibits gate 107 so that gate 100 is only opened during the narrow TG pulse applied via gate 125.

The above description has assumed that all the required conditions for the apparatus to function are satisfied. There are, however, several stages at which alternative situations may exist.

One of these concerns the signal lock condition resulting from the detection of three successive coincidences between signals from the signal selector 101 and the coincidence gate signals from gate generator 104. The bistable device 108 is continually being reset by pulses from decoding register 103 via pulse shaper 109, and the required count will only be achieved if the required coincidences occur. The coincidence detector has to be continually set, and if two expected coincidences do not occur the bistable device 112 is reset to produce the output $\overline{SL}$. A missed coincidence also means that gate 100 is closed and no input pulse can enter the decoding register. This stops the clock input to the coincidence shift register 110 since there is no input to the pulse shaper 109. To maintain the SL output during one missed coincidence to prevent the above situation, the last output from the coincidence gate is gated with the SL signal and the shift register clock in gate 115, and applied to the decoding register as a "synthetic" input pulse.

Another possible situation which may occur is that no pulse is received by the detector during the short transponding gate signal TG from monostable device 75. This may occur if, in addition to the desired signal representing the true target, spurious signals of the correct repetition rate occur during the period of the coincidence gate 104 due to scatter from cloud or from features of the terrain, or due to target countermeasures. In the event that the first signal to which the signal selector 101 is designed to respond is a spurious one, arriving perhaps from a direction different from that in which the target lies, signal lock may be achieved but no corresponding response is received during the gating period TC. In this case gate 117 operates instead of gate 116. This results in the state of JK flip-flop 120 changing to alter the signal selecting logic of the signal selector 101. In the example shown the removal of the signal P and its replacement by signal Q introduces "second pulse" logic, in that the first pulse is removed by the divide-by-two circuit in the signal selector and the second signal present during the coincidence gate period is selected instead. Since acquisition of the new signal usually requires re-alignment of the laser telescope in a new direction and the relinquishing of all range data derived from the former signal it is desirable to reset the system to the initial conditions listed above. Resetting is achieved by applying the output of gate G117 as a resetting signal RS to all resettable elements not already reset by the transponding gate signal TG. The sequence of signal acquisition is then repeated as above, except that a new signal selection mode is established by signal Q being present instead of signal P. The system will alternate between the two signal selection modes in the hope of picking up a train of genuine pulses.

The use of first and second pulse logic is only one way in which the signal selection mode may be changed. The system may be designed to respond to any required signal characteristic, and to alternate between two or more of these.

The above description relates to one way in which the invention may be put into effect. It will be apparent that the logic may be varied, and that other refinements may be added to counteract various countermeasures applied by the target. The final output of the system described is a range measurement and a direction, since the aircraft laser must finally be pointing directly at the marked target. Hence these outputs may be used to control the weapon system directly.

What I claim is:

1. A target identification system which includes a target marker capable of selecting, and directing radiation at, a target, a weapon delivery system to which the target is to be identified, means for establishing between the target marker and the weapon delivery system a two-way communication channel over which pulsed radiation may be transmitted from one to the other by reflection from the selected target, and means carried by the target marker and the weapon delivery system for so encoding the radiation transmitted over the communication channel as to identify uniquely the selected target to the weapon delivery system.

2. A system as claimed in claim 1 in which the target marker includes a laser operable to transmit radiation towards the target and a radiation-sensitive detector operable to receive laser radiation reflected from the target.

3. A system as claimed in claim 2 in which the radiation-sensitive detector carried by the target marker is provided with an optical system having an optical axis parallel to that of the laser carried by the target marker.

4. A system as claimed in claim 1 in which the weapon delivery system includes a laser operable to transmit radiation towards the target and a radiation-sensitive detector operable to receive laser radiation reflected from the target.

5. A system as claimed in claim 4 in which the radiation-sensitive detector carried by the weapon delivery system is provided with an optical system having an optical axis parallel to that of the laser carried by the weapon delivery system.

6. A system as claimed in claim 5 in which the radiation-sensitive detector carried by the weapon delivery system is sensitive to the direction of incidence of radiation falling upon it.

7. A system as claimed in claim 4 in which the weapon delivery system includes means operable to prevent the transmission of radiation by its laser except when the optical axis of the laser is directed towards an apparent source of radiation.

8. A system as claimed in claim 1 in which the encoding means carried by the target marker includes means for causing the laser carried thereby to emit a train of pulses of radiation at a predetermined repetition rate until a pulse of radiation is received by its radiation-sensitive device.

9. A system as claimed in claim 8 in which the encoding means carried by the target marker also includes means responsive to a received pulse of radiation to transmit a single pulse of radiation after a preset delay.

10. A system as claimed in claim 1 in which the encoding means carried by the target marker includes means for determining the range of the target from the target marker.

11. A system as claimed in claim 1 in which the encoding means carried by the weapon delivery system includes means responsive to the detection of a train of pulses of radiation having a predetermined repetition rate to generate a train of gating pulses.

12. A system as claimed in claim 11 in which the encoding means carried by the weapon delivery system also includes means responsive to a required number of coincidences between gating pulses and detected pulses of radiation to cause the laser to emit a single pulse of radiation.

13. A system as claimed in claim 1 in which the encoding means carried by the weapon delivery system includes means for determining the range of the target from the weapon delivery system.

14. A system as claimed in claim 2 in which the laser is operable to emit pulses of intra-red radiation.

15. A system as claimed in claim 14 in which the laser is a Q-switched device.

16. A target marker for a target identification system as claimed in claim 1 which includes a laser operable to transmit radiation towards the target and a radiation-sensitive detector operable to receive laser radiation reflected from the target.

17. A target marker as claimed in claim 16 in which the encoding means includes means for causing the laser to emit a train of pulses of radiation at a predetermined repetition rate until a pulse of radiation is received by its radiation-sensitive detector.

18. A target market as claimed in claim 17 in which the encoding means also includes means responsive to a received pulse of radiation to transmit a single pulse of radiation after a preset time delay.

19. A target marker as claimed in claim 16 which includes means for determining the range of the target from the target marker.

20. A weapon delivery system for a target identification system as claimed in claim 1 which includes a laser operable to transmit radiation towards the target and a radiation-sensitive detector operable to receive laser radiation reflected from the target.

21. A weapon delivery system as claimed in claim 20 in which the radiation-sensitive detector is sensitive to the direction of incidence of radiation falling upon it.

22. A weapon delivery system as claimed in claim 21 in which the encoding means includes means responsive to the detection of a train of pulses of radiation having a predetermined repetition rate to generate a train of gating pulses.

23. A weapon delivery system as claimed in claim 22 in which the encoding means also includes means responsive to a required number of coincidences between gating pulses and detected pulses of radiation to cause the laser to emit a single pulse of radiation.

24. A weapon delivery system as claimed in claim 20 in which the encoding means includes means for determining the range of the target from the weapon delivery system.

25. A system as claimed in claim 4 in which the laser is operable to emit pulses of infra-red radiation.

26. A system as claimed in claim 25 in which the laser is a Q-switched device.

* * * * *

UNITED STATES PATENT AND TRADEMARK OFFICE

CERTIFICATE OF CORRECTION

PATENT NO. : 5,350,134

DATED : September 27, 1994

INVENTOR(S) : CRAWFORD

It is certified that error appears in the above-indentified patent and that said Letters Patent is hereby corrected as shown below:

Col. 10,line 56 (Claim 14, line 2) "intra-red" should be --infra-red--.

Signed and Sealed this

Seventh Day of March, 1995

*Attest:*

*Attesting Officer*

BRUCE LEHMAN

*Commissioner of Patents and Trademarks*